United States Patent [19]

Kopse et al.

[11] 4,333,436

[45] Jun. 8, 1982

[54] SERVO OPERATED INJECTION NOZZLE-PUMP COMBINATION WITH CONTROLLED RATE OF SERVO PRESSURE CHANGE

[75] Inventors: Odon Kopse, Stuttgart; Kurt Ziesche, Remseck, both of Fed. Rep. of Germany

[73] Assignee: Robert Bosch GmbH, Stuttgart, Fed. Rep. of Germany

[21] Appl. No.: 10,619

[22] Filed: Feb. 9, 1979

[30] Foreign Application Priority Data

Feb. 17, 1978 [DE] Fed. Rep. of Germany ..... 2806788

[51] Int. Cl.[3] ..... F02M 39/02

[52] U.S. Cl. ..... 123/502; 123/467

[58] Field of Search ..... 123/139 AT, 139 DP, 123/139 E, 139 AK, 32 G, 467, 472, 501, 502

[56] References Cited

U.S. PATENT DOCUMENTS

| | | | |
|---|---|---|---|
| 3,752,137 | 8/1973 | Kimberley | 123/32 G X |
| 3,908,621 | 9/1975 | Hussey | 123/139 AT X |
| 3,921,604 | 11/1975 | Links | 123/139 E |
| 3,943,901 | 3/1976 | Takahashi | 123/139 AT X |
| 3,961,612 | 6/1976 | Okamoto et al. | 123/139 E |
| 4,069,800 | 1/1978 | Kanda et al. | 123/139 E X |
| 4,170,974 | 10/1979 | Kopse et al. | 123/139 AK |
| 4,182,492 | 1/1980 | Albert et al. | 123/139 E X |

*Primary Examiner*—Stuart S. Levy

*Attorney, Agent, or Firm*—Frishauf, Holtz, Goodman & Woodward

[57] ABSTRACT

To provide for gradual admission of servo fluid to then operate a fuel injection pump to pus injected fuel out through the nozzle, a control valve element is used which has a displacement or deflection-vs.-servo fluid admission characteristic which provides for hydraulic choking of pressurized servo fluid being admitted to a servo cylinder chamber upon initiation of a fuel injection event, and thereby provide for gradual build-up of injection pressure of the fuel. By suitable shaping of the choke ducts, the admission of fuel can be first of a small quantity, then interrupted, and then of a selected, for example full servo fluid quantity; this can be accomplished by forming an intermediate land on a control slider or rotary valve element with a connecting passage forming a choke; or gradually decreasing choking effect of fluid admission, for example by forming relatively movable control surfaces at an inclination so that, upon initial opening of a fluid path, the inclined surface will provide for a constricted passage-way which then gradually opens to full admission of pressurized servo fluid.

12 Claims, 9 Drawing Figures

SERVO OPERATED INJECTION NOZZLE-PUMP COMBINATION WITH CONTROLLED RATE OF SERVO PRESSURE CHANGE

The present invention relates to a fuel injection nozzle and pump combination, and more particularly to such a nozzle and pump combination to inject fuel into the cylinder of an internal combustion engine.

BACKGROUND AND PRIOR ART

Injection nozzle-pump combinations have been proposed which use a pump piston of a diameter smaller than the diameter of a servo piston connected thereto, the servo piston being subjected to fluid pressure by a servo fluid, such as oil or the like. A control arrangement is provided which operates in synchronism with the operation of the internal combustion (IC) engine to effect connection between a pressure source for the servo fluid and the servo pressure area, by selectively controlling a valve, typically a spool valve which has a slider spool. The quantity of fuel to be injected is determined by placing the pump working space or chamber in pressure-free condition before the pump piston actually carries out its pressure stroke. A certain quantity of fuel, predetermined in accordance with operating parameters of the engine, is then injected under substantial pressure as soon as the pressurized servo fluid is admitted to the servo cylinder to operate the servo piston, and hence the pressure piston which actually injects the fuel. In this system, the servo liquid is controlled by a spool valve and so conducted into a servo cylinder or servo pressure chamber that the servo piston then can control, directly, the cross section for the servo fluid duct. This arrangement permits influencing the injection mode, but does not provide for adequate control thereof and thus the servo-injection is difficult to apply widely. To control the servo fluid, typically an oil, the control slider has control edges which, by fitting against ports in the spool housing for the control slider, respectively control supply and drain of the servo liquid.

It has been found that the shape of the rising flank of the injection pulse of the fluid, upon injection, should be accurately controlled; this is difficult, if not impossible to achieve, with known structures.

THE INVENTION

It is an object to control the pressure rise in the pump working chamber upon admission of pressurized servo fluid to provide for better injection control of the fuel being injected by the nozzle, for example into the cylinder of an internal combustion engine.

Briefly, the control valve has a control element deflection-servo fluid admission characteristic which effects hydraulic choking of the servo fluid being admitted to the pump chamber or cylinder of the servo pump upon initiation of a fuel injection event or stroke to provide for gradual build-up of injection pressure of the fuel when an injection event is being commanded.

The delay in pressure rise, that is, flattening the pressure rise curve (with respect to time) in the servo cylinder or servo pump chamber permits more effective control of the injection event.

The hydraulic choke can be constructed in various ways. For example, one of the control edges of the spool valve which controls admission of servo fluid can be canted or made in a spiral to form the hydraulic choke. The pressure rise can also be delayed in the pump working chamber by using a pre-injection arrangement which includes an additional control groove formed in the slider or spool of the control valve. In accordance with another embodiment, and one which permits very effective control of pressure rise, additional element is used to control the delay of pressure rise within wide limits.

The valve which is used need not be a spool-type valve in which a slider spool can operate in longitudinally reciprocating motion; the valve can also be built in the form of a rotary valve in which a rotating control element controls passage of fluid to and form the servo pump or cylinder chamber, and by suitable shaping of the rotary or stationary element which cooperates with the rotary one of the valve, the pressure rise can be delayed or extended for controlled periods of time, or providing for admission of pressurized fluid in two stages, that is, providing for a pre-admission of pressurized fluid and subsequent full or final admission of the remainder thereof.

Drawings, illustrating preferred examples:

Figure 4:
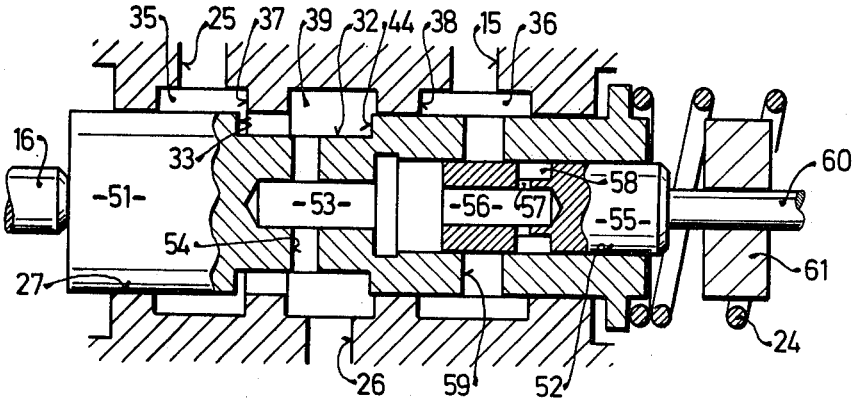
FIGS. 4, 5 and 6 are fragmentary axial views of spool valves in three different operating states.
Figure 5:
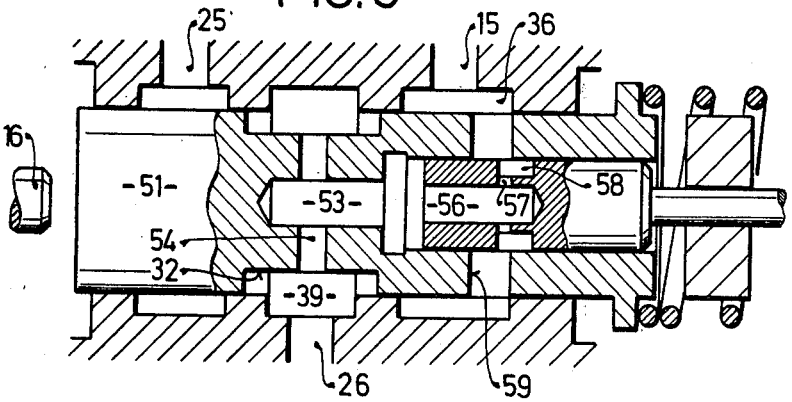
Figure 6:
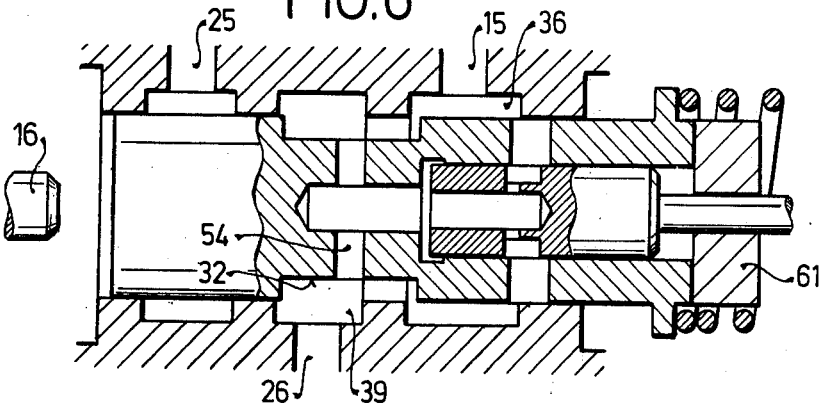

The drawings are not to scale, and only FIGS. 4 to 6 are drawn to the same scale.

GENERAL DESCRIPTION OF THE SYSTEM WITH REFERENCE TO FIG. 1

The nozzle-pump combination is the element within the chain-dotted outline. It has a nozzle portion 10, a control portion 9, a storage source of pressurized servo fluid 14, a return choke 12 which connects to a return line or sump, and a check valve 18. The combination is adapted for connection to the following external parts: A pump 13, to provide for pressurized servo fluid to the storage unit 14, supplying pressurized servo fluid through a supply line 15 to control unit 9. An external servo controller 16 is provided which can be a rotary distributor, a magnetic valve, a piston pump, or the like. An injection fuel supply 17 provides fuel through a line 19 to the check valve 18, the injection fuel supply 17 additionally controlling the quantity of fuel to be injected by the nozzle portion 10.

Figure 1:
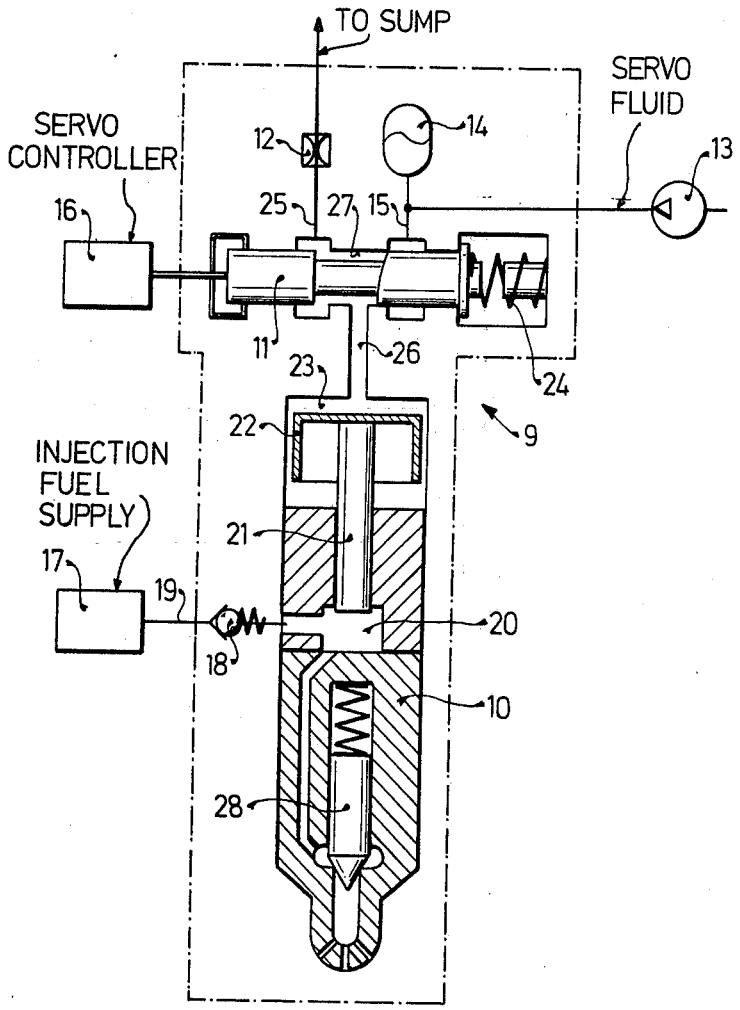
FIG. 1 is a highly schematic, part sectional view, partly in block form, of a fuel injection system using a servo arrangement with extended pressure rise.

The nozzle and pump combination unit itself has a fuel injection piston 21 which is connected to a servo piston 22, in the simplest form by being directly connected as shown in FIG. 1. When the piston is in its upper end position—as shown in FIG. 1—it just barely enters into the fuel cylinder 20, which is connected to the injection nozzle 28. Fuel which is supplied from the fuel supply 17 through line 19 and check valve 18 into the chamber or cylinder 20 is pressed through the nozzle exit openings upon downward stroke of the piston 21, the pressure of the piston 21 lifting the valve element within the nozzle 28 off its valve seat, against spring pressure, and thus causing fuel injection into the cylinder of an IC engine, as well known and standard in the technology involved. The control portion 9, in general, has a spool valve which has a slider spool 11, operating against a spring 24 and controlled by the servo controller 16 to permit either supply of pressurized servo fluid through inlet 15 to a connecting line 26 to enter into the servo cylinder chamber 23 or to drain through drain line 25 to a sump. The drain or return line 25 is shown schematically only. The valve, as shown in FIG. 1, is in its left terminal position and illustrates connection of the return flow of servo fluid from the servo cylinder 23 through outlet 26 and then through drain line 25 to the sump (not shown). The valve unit is, additionally, formed with a connecting passage 27 to provide, selectively, connection of the outlet line 26 to the cylinder chamber 23 either from the source of pressurized fluid 15 when the spool 11 is moved to the right or to the drain, when the spool is in the position shown.

In the following description, similar elements operating similarly, have been given the same reference numerals and will be explained but once.

DETAILED DESCRIPTION, EMBODIMENT OF FIG. 2

A housing portion, only shown generally, is formed with a bore 27 therein in which the slider spool 11 is longitudinally movable, to reciprocate between right and left. The spool slider 11 is formed with a recess portion 32 which is delimited at its left end by a control edge 33 extending transversely with respect to the longitudinal axis of the spool 11; at the right side, a control edge 34 is formed which is inclined or spiraled with respect to the longitudinal axis of the spool 11. The spool element 11 itself can reciprocate in the bore 27 which is formed with enlargements and entrance and connecting bores extending at right angle thereto, to form control fluid chambers. A drain chamber 35 is connected with the drain line 25; the drain chamber 35 is defined at the right side by a control edge 37. A supply chamber 36, having a control edge 38 at the left side thereof, is connected to the supply or pressure line 15 (FIG. 1). The servo fluid connecting line 26, which connects with the cylinder chamber 23 of the servo piston, is connected to a chamber 38, formed as a ring groove in the bore 27, located between the supply connection 15 and the drain connection 25.

OPERATION

Figure 2:
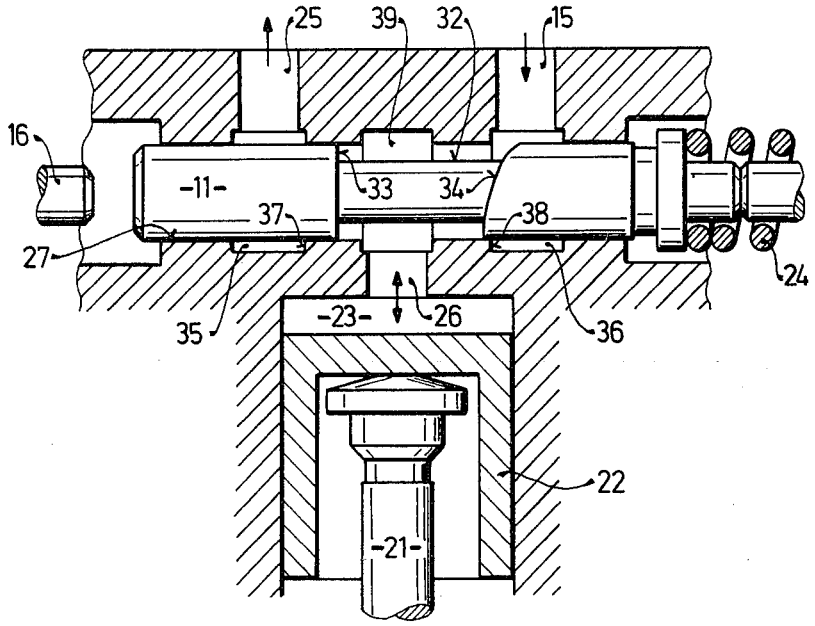
FIG. 2 is a fragmentary axial view through a spool-slider valve illustrating admission of servo fluid to a servo piston or servo chamber.

The control edges 33, 37 open or close drainage of servo fluid from the chamber 23 through connection 26 and chamber 39; similarly, the control edges 34, 38 control opening and closing of pressurized servo fluid from the pressure inlet 15 to the servo cylinder 23. The inclination of the control edge 34 with respect to the circumference of the spool 11 controls a changeable throttle or choke area as the spool 11 moves towards the right, against the pressure of spring 24, under command of the servo controller 16 from the left position, that is, after having previously covered both control edges 37 and 38. After the slider spool 11 has moved further to the right from the position shown in FIG. 2, the full opening connection between line 15 and connecting line 26 will be available for the pressure fluid.

Figure 9:
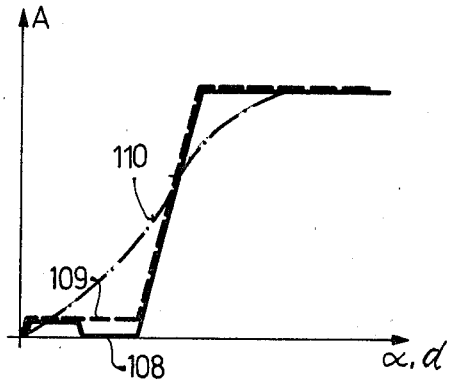
FIG. 9 is a diagram of flow cross-section for servo fluid as a function of angle of rotation of the rotary slider of FIG. 7 which, also, corresponds to lateral displacements of the spools of FIGS. 1 to 6.

FIG. 9 illustrates the approximate flow cross-section (ordinate) vs. displacement d (abscissa) relationship. As can be seen from FIGS. 2 and 9, the initial displacement of the slider spool 11 towards the right opens only a constricted fluid flow path between inlet 15 and the servo cylinder chamber 23 through the connection 26, so that a hydraulic choking or throttling of pressurized servo fluid is obtained upon initial admission thereof. The throttle opening changes gradually to become larger and larger, as the spool 11 moves towards the right until unobstructed communication is available (see curve 110).

EMBODIMENT OF FIG. 3

Figure 3:
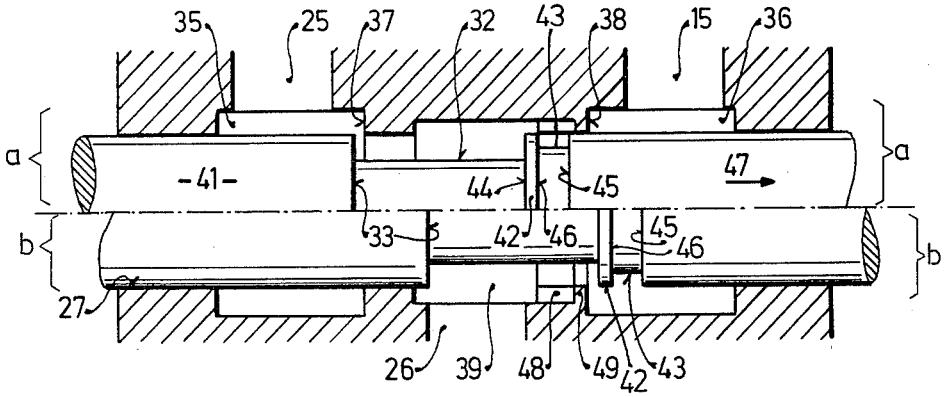
FIG. 3 is an axial view of another embodiment of the spool-slider valve in which a pre-admission of fluid is provided, to be followed by the full or final admission of servo fluid under pressure, the drawing showing in two portions a and b two positions of the spool for better illustration of the operation.

A spool slider 41 reciprocates in the bore 27 of the housing. The portion a of FIG. 3 illustrates the spool slider 41 at a left position, the portion b below the chain-dotted line the same spool slider displaced towards the right in the direction of the arrow 47. The positions of the spool slider 41 are the respective left and right terminal positions. The spool 41 has a control ring or recess 32 with edges 33, 44. The control edge 44, in contrast to the edge 34 of FIG. 2, extends perpendicularly to the circumference of the slider 41, that is, the edge 44 is transverse to the axis of the spool 41. The spool 41 has a further and additional control ring 43 cut therein, forming two pre-control edges 45, 46. The control rings or recesses 32, 43 are separated by a ring 42 of the same diameter as the remainder of the spool 41. The housing is formed with an internally projecting ring 49 which defines a supply control edge 38 in communication with the pressure inlet 15. The chamber 39, communicating with the control outlet 26 which leads to the cylinder chamber 23 of the servo piston is formed with a plurality of pockets 48 which function as initial supply hydraulic chokes.

OPERATION

Considering first the slider 41 to be in its left extreme position, that is, the portion a of the slider illustrated in FIG. 3. The control edges 33 and 37 are removed from each other—which may be termed, have negative covering—so that servo fluid can drain from the chamber 26 through the drain opening 25. If the slider 41 then is moved in the direction of the arrow 47 towards its right terminal position, as illustrated in the portion b thereof, the control edges 38 then, first, and for a short period of time, the pressure supply line 15 will be connected to the communication duct 26 through the groove 43 in the spool 41 communicating with the pockets 48 which open the chamber 39, since the control edge 38 and the edge 45 will have negative covering or, in other words, will be free of each other. The ring 42 on the spool 41 will come in covering engagement with the inwardly projecting ring 49, thus interrupting the flow connection between the inlet 15 and the chamber 39. Upon further travel to the right of the spool 41, the ring 42 and the inwardly projecting ring 49 will again come out of engagement, and only when the control edges 38, 44 are completely free of each other, that is, in the terminal position shown in the portion b of FIG. 3, will the pressure inlet 15 be completely connected to the connecting duct 26 communicating with the cylinder chamber 23. A preinjection of pressurized servo fluid will occur when the ring groove 43 is in communication with the pressure inlet 15 and the pockets 48 which will effect a controlled admission of pressurized fluid to the servo cylinder, pre-injection of fuel is controlled and delayed since the pressure rise in the servo cylinder 23 (FIG. 1) is delayed by admitting pressurized servo fluid under choking conditions, through the choke path formed by the narrow groove 43 and the pockets 48. Thus, pressure rise is delayed similarly to the delay due to the inclined control edge 34, FIG. 2.

EMBODIMENT OF FIGS. 4 TO 6

An additional auxiliary control piston 55 is needed in this embodiment; the additional element, however, has the advantage that the rate of pressure rise in the servo cylinder chamber 23 can be controlled within wide limits. The spool valve element 51 has an auxiliary control piston 55 located therein. Spool cylinder 51 operates within the bore 27 of the housing as before. Spool 51 has a cylindrical portion 52 in which, coaxially therewith, a blind bore 53 is formed which is connected with a cross bore 54 which, in turn, is connected to the control ring groove 32 formed in the spool 51. The wall of the cylinder portion 52 is formed with a radial bore 59. The auxiliary slider 55 is longitudinally movable within the axial bore 52 in the spool 51. It is formed with a control ring groove 58 extending inwardly from its circumference, and connected through a narrow choking or throttle opening 57 to a blind hole 56 drilled axially within the auxiliary slider 55. The blind bore 56 in the auxiliary slider 55 extends from one end towards the right, as seen in FIGS. 4–6. An adjustable stop 60, secured to the stop 61, extends to the left and engages the auxiliary piston or slider 55. The slider 55 engages the stop element 60 therefor due to the pressure tending to move the auxiliary slider or piston 55 to the right exerted thereon by the servo fluid.

OPERATION

The left terminal position of the slider 51 is illustrated in FIG. 4. The drain line 25 is connected to the connecting duct 26 so that servo fluid can drain from the cylinder chamber 23 through chamber 39, between the control edges 33, 37 and out from the drain chamber 35 and the drain duct 25.

Upon movement of the spool 51 to the right, as shown in FIG. 5, controlled admission of pressurized servo fluid is effected; pressurized servo fluid derived from connection 15 is applied, under throttled conditions, to the connecting line 26 communicating with the cylinder chamber 23. The path of pressurized servo fluid is from the pressure inlet 15—chamber 36—cross bore 59 in slider 51—groove 58 in auxiliary piston 55—throttle bore 57—blind bores 56 and 53—cross bore 54—control ring groove 32—chamber 39—to the connecting duct 26. The connection, thus, is through a choke or throttled path and effects delay of pressure rise in the servo chamber 23 (FIG. 1).

Upon further movement of the slider 51 to the right, as seen in FIG. 6, the slider 51 will engage the stop 61. The supply line 15 will thus be connected to the connecting duct 26 not only through chamber 36 and the ring groove 32 of the main slider but, additionally, through the throttled path described in connection with FIG. 5. The hydraulic path of FIG. 6, in addition to that of FIG. 5, will be: line 15—chamber 36—ring groove 32—cross bore 54—chamber 39—connecting duct 26.

The admission of pressurized fluid in accordance with FIGS. 4 to 6 will be approximately in accordance with the flow cross-section represented by the broken line 109 of FIG. 9, in which, again, the abscissa denotes displacement towards the right of the spool 51; this contrasts with the solid-line curve 108 which represents approximately the relationship of flow cross-section with respect to displacement of the spool 41 of FIG. 3; the interruption of fluid upon matching engagement of the respectively outwardly and inwardly extending rings 42, 49 (FIG. 3) can be clearly seen.

EMBODIMENT OF FIGS. 7 AND 8

The basic operation is the same as that of the previously explained embodiments, or can be made similarly if desired. The arrangement, however, is such that the valve element is not the spool slider operating in reciprocating movement but, rather, is a rotary element; the servo controller 16 then will provide an output which is rotary, rather than reciprocating, or is converted to be rotary, for example by a crank arm (not shown).

Figure 7:
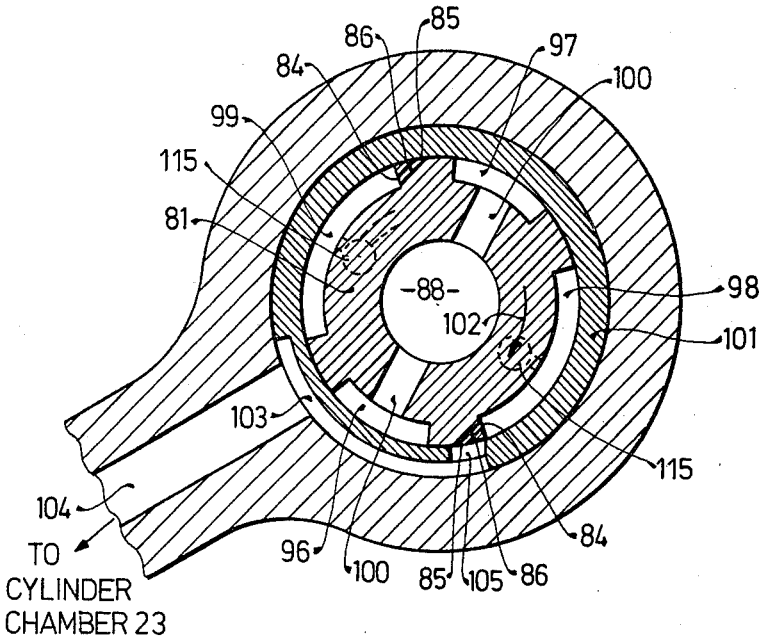
FIG. 7 is a transverse sectional view through a rotary valve.

The valve element is a rotary slidable core element 81 which, for simplicity and consistency of terminology, can be termed a rotary slider. It is generally cylindrical and operable in a housing element. The rotary slider 81 is formed with two diametrically oppositely located axially extending control grooves 96, 97 which communicate through radial bores 100 with a central axially extending bore 88 which, in turn, is in communication with the drain line. The slider 81, which can rotate within a fixed sleeve 101 located in the housing, additionally is formed with axially extending pressure control grooves 98, 99 which are in communication with short radially extending ducts which, in turn, communicate with end openings 115 in the form of a ring connection and which are connected to the pressure inlet 15 (FIG. 1). Thus, the control grooves 96, 97 control drainage of servo fluid; the control grooves 98, 99, all diametrically located, the admission of pressurized servo fluid. The grooves are located at the circumference of the rotary slider 81 in alternate sequence, as seen in FIG. 7. The sleeve 101, within which the rotary slider 81 is located, is formed with an outer relief or groove 103 which is continuously connected to the connecting duct 104 which communicates with cylinder chamber 23 (FIG. 1) similar to the ducts 26 of FIGS. 2–6. The sleeve 101 is formed, additionally, with a radially extending connecting opening 105 which can be selectively placed in communication with respective ones of the control grooves in the rotary slider 81.

The slider 81 has two choke connecting bores 86, located diametrically opposite with respect to each other. The choke bores 86 have inlet openings 84 which are connected to the pressure control grooves 98, 99, respectively, and have outlet openings 85 which can be placed, selectively, in communication with the connecting opening 105 of the sleeve 101.

OPERATION, WITH REFERENCE ALSO TO FIGS. 8 AND 9

If the rotary slider 81 is turned about 20° counterclockwise (FIG. 7), the drain groove 96 is in communication with the communicating duct 104 through groove 103 of sleeve 101, opening 105, and duct 96. Upon subsequent rotation of the slider 81 to the position shown in FIG. 7, the choke bore 86 will connect the pressure groove 98 with the opening 105 in the sleeve 101. Pressurized servo fluid thus can flow from the inlet and duct 115 through pressure groove 98, choke connection 85, the radial opening 105 in sleeve 101, groove 103 to the duct 104 and hence to the cylinder chamber 23.

Figure 8:
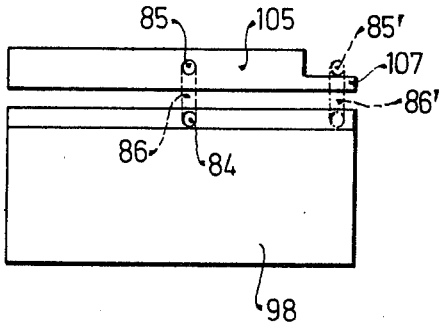
FIG. 8 is a portion of the control groove of FIG. 7, in developed form, together with the rotary element of FIG. 7, also developed.

The position of the throttle duct 85 with respect to the width of the opening 105 can be selected to provide different flow patterns of displacement of the slider 81 with respect to the flow of pressurized servo fluid to the cylinder chamber 103. FIG. 8 illustrates two such arrangements.

The relative positioning of the bore 86 and the outlet opening 85 thereof with respect to the pressure groove 98 and the opening 105 is shown in developed form in FIG. 8. The distance of the outlet opening 85 from the subsequent pressure groove 98 can be the same as or less than the width of the opening 105. If this arrangement is selected then, first, a small quantity of pressurized servo fluid is admitted to the opening 105 upon rotation of slider 81 in the direction of the arrow 102. Upon further rotation of the slider 81, the groove 98 will come in communication with the opening 105 and thereupon the entire pressurized servo fluid can flow to the cylinder chamber; the quantity of fluid being supplied thus rises rapidly. The curve of flow cross-section with respect to angle of rotation $\alpha$ is shown in the broken line 109 of FIG. 9. The ordinate shows the flow cross-section, the abscissa the angle of rotation of slider 81. The curve 109 arises when the distance between the outlet opening 85 and the control edge of the subsequent control groove—in this case outlet 105—is smaller than or the same as the width of the cross section of the opening 105.

The arrangement can be made differently, however, namely for example by making the exit opening 105 larger than the width of the opening 85. If this embodiment is selected—as seen on the right side of FIG. 8 in broken-line connection with reference numerals with prime notation—then, after first admission of fluid from the groove 98 through opening 105 to the groove 103, the outlet opening 85 is again closed before the direct connection between the pressure groove 98 and the outlet 105 is established. The resulting curve of displacement angle vs. flow cross-section is shown in the solid-line curve 108 of FIG. 9. If any mode of injection in accordance with this curve is desired, the angle of the bore 86, or the outlet opening thereof, is so selected that the distance of the outlet opening 85 from the subsequent control edge is greater than the width of the opening 105. The resulting flow will be first a throttled supply of pressurized servo fluid, then an interruption, and then the main supply of servo fluid—in accordance with the solid-line curve 108, FIG. 9. The servo fluid being supplied thus will be in stages, with an initial throttled supply, an interruption, and then the main supply.

The interrupted supply, in accordance with the solid-line curve 108 of FIG. 9, can also be controlled by the structure of FIG. 3. In accordance with FIG. 7, the slider 81 can be made to be axially movable. Thus, outlet 85 will be axially shifted to cooperate with the full opening 105 or with a portion which is restricted in width by a projection 107 (omitted from FIG. 7 for clarity and shown in FIG. 8 only). The corresponding position of the choke bore 86' is shown in chain-dotted lines. If the slider 81 is axially shifted for communication of the choke bore with the opening 105, as reduced by the projection 107, the injection corresponding to curve 108 can be obtained; upon re-positioning in axial direction of the slider, the injection curve corresponding to 109 can be obtained.

Thus, upon axial shifting of the slider 81, either one of the choke bore positions 86 or 86' can be brought in communication with the respective cross section defined by 105, or 107, respectively, and thus different modes of application of pressurized servo fluid can be obtained. Additionally, the arrangement can be so placed that, upon shifting of the rotary slider 81 in opposite direction, the bore 86' is completely removed from engagement with the cross section 105, 107 which then will result in application of pressure fluid without any preliminary introduction of pressure fluid at all.

The slider 81 is, preferably, symmetrical so that cyclical application of pressurized servo fluid can be obtained upon continuous rotation thereof, the mode of application of the pressurized fluid—slowly rising with choke effect, preapplication of pressure reduced fluid or full application thereof being controlled by relative axial shifting of the slider 81.

Various changes and modifications may be made, and features described in connection with any one of the embodiments may be used with any of the others, within the scope of the inventive concept. For example, sleeve 101 can be rotatably adjustable.

We claim:

1. Fuel injection nozzle-pump combination for an internal combustion engine having a nozzle body (10) formed with nozzle openings therein;

a fuel chamber (20) in said nozzle body;

a source of fluid fuel (17) in fuel communication with the chamber and providing a predetermined quantity of fuel thereto;

a pump piston (21) positioned in said body to exert pressure on the fuel fluid in said chamber and effect injection of fuel from the nozzle openings;

a source of pressurized servo fluid (13, 14, 15);

a servo fluid cylinder (23), said pump piston being subjected to pressure in said cylinder (23);

a control valve including a valve housing and a movable valve element (41, 51, 81) providing a fluid flow path for pressurized servo fluid and controlling by means of control edges admission of pressurized servo fluid from said source to said cylinder, said control valve having control edges (33, 37, 44, 96) at adjacent locations of said valve housing and movable valve element which form a throttle for fluid flow upon initial displacement of the movable element;

servo control means (16) controlling the positioning of the movable valve element of said control valve to thereby control, selectively, admission of said pressurized servo fluid to the cylinder and hence movement of the piston (21) into the fuel chamber to inject fuel from the nozzle openings and wherein said valve, in addition to said control edges (33, 34, 37 34) further comprises additional throttle means (43, 48, 57, 86) forming a hydraulic choke or throttle for hydraulically choking or throttling the servo fluid, said additional throttle means being inserted in the servo fluid flow path upon initial displacement of the movable valve element (41, 51, 81) from a position blocking the fluid flow path to a position establishing an open unconstricted fluid flow path from the source of pressurized servo fluid (13, 14, 15) to the servo cylinder (23) to provide for initial controlled throttling of flow of the servo fluid being admitted to the servo cylinder and hence gradual buildup of pressure of the servo fluid acting on the pump piston (21) upon commencement of fuel injection.

2. Fuel injection nozzle-pump combination for an internal combustion engine having a nozzle body (10) formed with nozzle openings therein;

a fuel chamber (20) in said nozzle body;

a source of fluid fuel (17) in fuel communication with the chamber and providing a predetermined quantity of fuel thereto;

a pump piston (21) positioned in said body to exert pressure on the fuel fluid in said chamber and effect injection of fuel from the nozzle openings;

a source or pressurized servo fluid (13, 14, 15);

a servo fluid cylinder (23), said pump piston being subject to pressure in said cylinder (23);

a control valve including a valve housing element and a movable valve element (41, 51, 81), said valve housing and movable valve element being formed with thro means comprising mutually cooperating grooves and control edges adjacent said grooves to provide a selectively open or closed controllable fluid flow path for pressurized servo fluid and controlling admission of pressurized servo fluid from said source to said cylinder;

servo control means (16) controlling the positioning of the movable valve element of said control valve to thereby control, selectively, admission of said pressurized servo fluid to the cylinder and hence movement of the piston (21) into the fuel chamber to inject fuels from the nozzle openings, and comprising, in accordance with the invention additional throttle means forming a hydraulic choke or throttle (43, 48, 57, 86) including at least an additional chamber limited by an additional control edge formed in the movable valve element (41, 51, 81), said additional throttle means being inserted in the servo fluid path upon initial displacement of the movable valve element (41, 51, 81) from a position blocking the fluid flow path to a position establishing an open unconstricted fluid flow from the pressurized fluid source to the servo cylinder to provide for initial controlled throttling of the servo fluid being admitted to the servo cylinder and hence gradual build-up of pressure of the servo fluid acting on the pump piston (21).

3. Combination according to claim 2 wherein the movable valve element comprises a slider (41) movable in an opening formed in the housing;

recesses defining fluid chambers located adjacent the slider opening in the housing and defining control edges at the junction with the slider opening;

recesses defining control grooves located at the circumference of the slider and having the control edges at the junction with the surface of the slider;

connecting duct means (26, 104) connecting one of said chamber with the cylinder (23);

connecting means (15, 25) respectively connecting pressurized servo fluid to the valve and draining servo fluid from the cylinder from the valve;

wherein the chambers and grooves in the housing and the slider, respectively, are so located with respect to each other that, in dependence on the position of the slider, as controlled by the servo control means (16), the slider surface will inhibit fluid communication between the fluid connection duct (26, 104) and the pressure or drain line (15, 25), respectively;

and wherein the additional throttle means (43, 48, 57, 86) comprises means in addition to said control edges and operatively associated with the slider formed to define said additional throttle means upon movement of the slider towards a position establishing full communication between the source of pressurized servo fluid (13, 14, 15) and the servo fluid cylinder (23).

4. Combination according to claim 2, wherein the movable element comprises a longitudinally movable, reciprocating spool valve-type slider (41, 51).

5. Combination according to claim 2, wherein the slider is a movable element comprising a rotary slider (81).

6. Combination according to claim 2 wherein the movable element comprises a slider (41)

and the additional throttle means comprises a groove (43) and two additional control edges (45, 46) limiting the lateral extent of the groove and located adjacent the chamber which establishes communication between the source of pressurized fluid (13, 14, 15) and the cylinder (23) so that, upon movement of the slider, the control edges adjacent the groove provide for preliminary admission of a limited amount of pressurized servo fluid to the the cylinder (23) in advance of establishment of open communication between the pressure supply duct (15) and the connection duct (26).

7. Combination according to claim 6, wherein the groove (43) and the control edges are formed on the slider (41);

and the chamber (39) formed in the housing and establishing communication to the cylinder (23) is formed with pockets (48) to decrease the flow upon initial establishment of fluid communication between the source of pressurized servo fluid (13, 14, 15) and said chamber by the groove (43) upon movement of the slider.

8. Combination according to claim 2 wherein the movable valve element comprises a longitudinal slider (51);

an auxiliary piston (55) is provided axially movable with respect to the slider and located within a bore (52) formed in the slider, the auxiliary piston being formed with hydraulic connection duct means (56, 57, 58) and establishing communication, during movement of the slider, through a constriction (57) to form the additional throttle means between the source of pressurized fluid (13, 14, 15) and the cylinder (23).

9. Combination according to claim 8, wherein the hydraulic connection duct means comprise a groove (58) formed at the outer circumference of the auxiliary piston (55);

a blind bore (56) is provided terminating at an axial end of said auxiliary piston and extending beneath said groove (58);

the constriction comprises a constricted connection (57) between the groove and the blind bore (56);

the slider (51) being an axially movable spool-valve slider and formed with a blind bore (53) therein, in axial alignment with auxiliary piston (55) and the blind bore (56) in the auxiliary piston, and a radial communication (54) between the blind bore in the spool-type slider (51) and the chamber (39) communicating with the connection duct (26) leading to the cylinder (23);

and a second radial connection (59) formed in the spool-type slider (51) and establishing, selectively, communication between the pressure supply duct (15) and the groove (58) of the auxiliary slider in dependence on the position of the spool slider (51) as controlled by said servo controller (16).

10. Combination according to claim 2, wherein the movable valve element is a rotary slider (81), the rotary slider being formed with two pressure chambers (98,99) connected to the source of pressurized servo fluid, and further formed with two drain chambers (96, 97) connected to the drain for the servo fluid;

a sleeve (101) surrounding the rotary slider (81) positioned in the control valve housing, the sleeve being formed with a connection chamber (103) communicating with the connection duct (104) and hence with the cylinder (23);

a connection opening (105) communicating with the connection chamber (103) and permitting, selectively, connection of the pressure chambers of the drain chambers of the rotary slider with the connection chamber and hence supply to, or drain from, the cylinder (23);

and wherein the additional throttle means comprises a constricted connection choke bore (86) extending from at least one of the pressure chambers towards the outer circumference of the rotary slider (81) to provide for advance hydraulically choked connection of pressurized servo fluid from a pressure chamber to the connection chamber (103) before establishing hydraulic fluid communication between a pressure chamber and the connection chamber directly.

11. Combination according to claim 10, wherein the distance of the exit opening of the constricted connection choke bore (86) and the edge of the pressure chamber adjacent said bore is not greater than the width of the connection opening (105) to provide for admission of throttled, pressurized servo fluid to the connection opening and hence to the connection chamber (103) and, subsequently and immediately following, full fluid communication between the pressure chamber and the connection opening and hence the connection duct (104) and provide a supply fluid admission characteristic of an initial supply of choked or throttled pressurized servo fluid followed by pressurized servo fluid at full pressure.

12. Combination according to claim 10, wherein the connection opening (105) has a portion of reduced width which is axially offset with the remainder of said connection opening;

and wherein the rotary slider is axially movable to shift the bore (86), exit opening (85), selectively, to respective portions of the connection opening and thus change the mode and characteristics of admission of pressurized servo fluid to the connection chamber (103) and hence to the cylinder (23) in dependence on the axial position of the rotary slider.

* * * * *

UNITED STATES PATENT AND TRADEMARK OFFICE

CERTIFICATE OF CORRECTION

PATENT NO. : 4,333,436

DATED : June 8, 1982

INVENTOR(S) : Odon KOPSE et al

It is certified that error appears in the above-identified patent and that said Letters Patent is hereby corrected as shown below:

Claim 2, column 9, line 22, change "thro means" to -- throttle means --

Claim 2,column 9, line 33, change "fuels" to -- fuel --

Claim 10, column 11, line 22, change "of the",(second occurrence),to -- or the --

Signed and Sealed this

Twenty-ninth Day of March, 1988

*Attest:*

DONALD J. QUIGG

*Attesting Officer*

*Commissioner of Patents and Trademarks*